US005553536A

United States Patent [19]

Van Os

[11] Patent Number: 5,553,536

[45] Date of Patent: Sep. 10, 1996

[54] SCREEN PRINTING APPARATUS WITH VACUUM CONVEYOR BELT

[75] Inventor: Arlen Van Os, Grandville, Mich.

[73] Assignee: Van Os Enterprises, Jenison, Mich.

[21] Appl. No.: 317,121

[22] Filed: Oct. 3, 1994

[51] Int. Cl.[6] ..... B41F 15/20

[52] U.S. Cl. ..... 101/44; 101/115; 101/123; 101/126; 101/425; 15/104.002; 198/689.1; 221/310; 414/728; 414/737; 414/788.7; 414/797.8

[58] Field of Search ..... 101/37, 41, 43, 101/44, 115–118, 123, 126, 129, 424.1, 425, 474, 124; 15/1, 3, 104.002; 414/728, 737, 742, 795.3, 797.8, 798.1, 788.7; 221/310; 198/689.1

[56] References Cited

U.S. PATENT DOCUMENTS

| | | | |
|---|---|---|---|
| Re. 29,206 | 5/1977 | Jaffa | 101/126 |
| 3,313,929 | 5/1964 | Rehm | 198/689.1 |
| 3,443,706 | 5/1969 | Puhm | 414/798.1 |
| 3,506,129 | 4/1970 | Crombie | 210/401 |
| 3,638,564 | 2/1972 | Prange et al. | 101/126 |
| 3,877,371 | 4/1975 | Jaffa | 101/126 |
| 3,957,423 | 5/1976 | Mueller | 101/425 |
| 3,987,725 | 10/1976 | Scantlin | 101/129 |
| 4,063,503 | 12/1977 | Ichinose | 101/126 |
| 4,068,579 | 1/1978 | Poo et al. | 101/124 |
| 4,256,037 | 3/1981 | Vertegaal | 101/115 |
| 4,561,354 | 12/1985 | Glantschnig et al. | 101/120 |
| 4,646,911 | 3/1987 | Pearl et al. | 198/689.1 |
| 4,813,351 | 3/1989 | Pierson, Jr. | 101/115 |
| 4,903,592 | 2/1990 | Ericsson | 101/126 |
| 4,998,470 | 3/1991 | Klemm | 101/115 |
| 5,048,416 | 9/1991 | Iijima | 101/115 |
| 5,050,497 | 9/1991 | Klemm | 101/124 |
| 5,054,761 | 10/1991 | Dietrich et al. | 414/797.8 |
| 5,090,311 | 2/1992 | Brasa | 101/115 |
| 5,092,239 | 3/1992 | Bubley | 101/115 |
| 5,135,317 | 8/1992 | Greenwood et al. | 101/35 |
| 5,160,505 | 11/1992 | Seveno et al. | 8/471 |
| 5,245,922 | 9/1993 | Klemm | 101/115 |
| 5,259,496 | 11/1993 | Common | 198/803.15 |
| 5,261,654 | 11/1993 | Kerber et al. | 271/183 |

FOREIGN PATENT DOCUMENTS

| | | | |
|---|---|---|---|
| 102743 | 3/1984 | European Pat. Off. | 101/115 |
| 132150 | 1/1985 | European Pat. Off. | 198/689.1 |
| 4107884 | 9/1992 | Germany | 414/795.3 |

*Primary Examiner*—Stephen R. Funk
*Attorney, Agent, or Firm*—Young & Basile

[57] ABSTRACT

A screen printing apparatus transfers an image onto a substrate. A feed mechanism is provided for moving the substrate along a fixed linear path. Vacuum is provided through the feed mechanism for holding the substrate in at least one position along the fixed linear path. A printing head transfers the image onto the substrate while the substrate is held in a first position by the vacuum. A curing station is provided for fixing the image transferred to the substrate while it is passing through the curing station, or while it is being held in a second position by the vacuum applied through the feed mechanism.

11 Claims, 5 Drawing Sheets

SCREEN PRINTING APPARATUS WITH VACUUM CONVEYOR BELT

FIELD OF THE INVENTION

The present invention relates to a screen printing apparatus for transferring an image onto a substrate, and more particularly, to a screen printing apparatus having a linear feed path for the substrate to be printed, where the substrate is held by vacuum pressure at least during the printing operation.

BACKGROUND OF THE INVENTION

Previously known carousel printers require bulky rotating pallets. The large steel dial used in the typical carousel printer has many parts, and due to its size, will change shape and size resulting in poor registration control and poor quality finished product. The circular pattern of the typical existing carousel printer cannot be expanded. The operator of a carousel printer is positioned at the back of the printing machine with poor access to the screen area. The design of carousel printers wastes valuable floor space and cannot be adapted to print roll to roll. A flat bed carousel style screen printing press with a vacuum distribution apparatus can be seen in U.S. Pat. No. 5,092,239.

Machines for multi-color silk-screen printing are also known and typically include a plurality of tables or supporting pallets sliding along an oval path with a plurality of fixed work stations. Each of the fixed stations can include a printing head or a drying head according to a predetermined sequence depending on the type of printing to be carried out and on the number of colors to be used in the printing process. This type of screen printing apparatus is disclosed in U.S. Pat. No. 5,090,311. While the oval path, sliding table screen printing apparatus overcomes many of the disadvantages of the previously known carousel type printing apparatus, it still suffers from the disadvantage of wasting valuable floor space, being difficult to expand and requiring re-registry of the article to be printed at each fixed station.

Multi-color screen printing and curing devices are also known having a shiftable printing head that carries a plurality of screen printing units that are each adapted to print an inked image of a color or texture different than the images printed by the other printing units. In this type of device, after the printing head has been lowered toward a web of material to be imprinted, each printing unit produces an inked image on respective, successively oriented defined areas of the web. The printing head is then raised, and a curing device such as an ultraviolet lamp is moved across all of the inked images on the web. Once each image has cured, the web advances one step to bring each of the defined areas of the web into registration with the next adjacent, downstream printing unit and the cycle is then repeated to build up a multi-color or multi-textured composite image. A linear feed screen printing apparatus for imprinting continuous webs of material is disclosed in U.S. Pat. No. 4,813,351. While this type of device provides linear feed of continuous links of material to be imprinted, it suffers from the disadvantages of supporting the material to be imprinted on a stationary table and pulling the material to successively advance it step to step from station to station during the printing process potentially leading to stretching of the material and improper registration of the material after it has been moved. In addition, this device suffers the disadvantage of having to physically move the printing head to make way for the application of a curing device to the inked images on the web prior to advancing the web.

In a pallet type screen printing machine, a pallet is indexed to a printing station where an article supported thereon is screen printed. A feed table with guides is typically provided to facilitate the accurate positioning of a workpiece onto the pallet at a feed station. As disclosed in U.S. Pat. No. Re. 29,206, this type of machine can include an endless drive for moving one or more pallets to and from a printing station in an endless path, where the face of the pallet is always maintained in a face up position. The pallet is formed to define a vacuum chamber which is operatively connected to a source for drawing a negative pressure thereon. A flexible coupling is required operatively connecting the pallet to the endless drive to permit limited movement of the pallet so that the pallet may be brought into accurate registration with the printing head at the printing station. Registration of the pallet in the printing station is effected by a locating cam and a cooperatively associated cam follower, which when activated, will effect the required alignment and registration of the pallet with the printing head. While this device discloses a linear feed path and application of vacuum to the workpiece at the printing station, it suffers from the disadvantage of using one or more pallets, which requires the accurate positioning of the workpiece with respect to the pallet and thereafter accurate positioning of the pallet with respect to each printing station.

Conveyorized vacuum tables have previously been proposed for feeding and supporting sheet material using a penetrable support bed and a plurality of vacuum chambers which move with the support bed and communicate with it. Vacuum is applied to the vacuum chambers to cause the conveyor to hold the sheet material in place on the conveyor during cutting or feeding operations. A conveyorized vacuum table of this type is disclosed in U.S. Pat. No. 4,646,911. Typically, conveyors of this type are manufactured with flexible belt materials, such as woven fabric, rubber or the like. These types of flexible materials are subject to stretching during use and cannot be easily adapted for reliably positioning an article carried thereon accurately with the desired degree of repeatability. This limitation has made such conveying systems unsuitable for use in conveying workpieces for screen printing devices.

A perforated steel belt conveyor is disclosed in U.S. Pat. No. 3,506,129 for separating solids from liquids. The perforated steel belt conveyor is used as an endless belt sieve. Liquid containing solids is delivered to the top surface of the belt and passes through perforations in the belt as the belt moves at a small upward incline to the horizontal and the solids remain on the belt surface.

SUMMARY OF THE INVENTION

The present invention relates to a screen printing apparatus with a vacuum conveyor belt. A thin, perforated belt, made out of suitable material, such as stainless steel, is used to carry materials between the printing and curing stations. This belt rides on a surface with grooves that align with apertures in the belt to allow the vacuum to act on substrates that are placed on the belt. The materials on the belt do not need to be re-registered after each printing impression. This eliminates the possibility of inaccurate registration between colors, reducing rechecks and also reducing the amount of equipment needed. Printing all of the colors during a single process cycle at one time as the substrate moves along the fixed linear path versus separate operations, means that the first parts off from the printing apparatus can be shipped immediately, resulting in quicker turnover and cash flow. This is especially important when the customer needs to see the first parts in order to approve the product, or when the customer needs prototypes. Also, the present invention is very helpful to the printer operator, because the printer operator can see the finished product and make sure that every color is aligned properly and producing a good finished appearance. In a one-color-at-a-time process approach, the printer operator must trust that everything will align properly and achieve the desired final appearance, since a finished product with the final colors applied is sometimes days into the future.

The thin, perforated belt of the present invention is a very low weight compared to the bulky rotating pallets presently used in carousel printers. The present invention eliminates the need for large expensive mechanical indexers, and the process of the present invention is faster, because the printing areas are in closer proximity to one another and the low mass of the belt allows faster startup and stopping. The linear printing machine according to the present invention places the operator in a more convenient position with access to all the important areas of the apparatus. The linear belt line of the present invention can be expanded without difficulty. The linear printing machine according to the present invention can be easily adapted to print from roll to roll if required.

The screen printing apparatus according to the present invention is particularly well adapted for use in printing information on plastic cards, approximately the size of a credit card. An automatic loader is provided at the upstream side of the printing apparatus feeding a loading device which takes one of the plastic cards and places it in the appropriate position over apertures formed in the vacuum belt. The vacuum is applied through the perforations of the vacuum belt to hold the plastic card, or other substrate, in place as the vacuum belt is indexed along the linear path of the apparatus. The linear path may include a cleaning station, at least one screen printing station and at least one curing station. After curing, the plastic cards are stacked at the downstream side of the machine. The plastic cards are generally spaced on four inch centers along the linear path and can be registered at each station within 0.0001 of an inch. The thin, lightweight belt of the present invention provides for accurate starting and stopping of the vacuum belt and, therefore, allows for faster speeds during production, and also requires lower horse power for operation.

The present invention can also be adapted for roll to roll screen printing by providing rubber rollers to urge the continuous sections of the roll substrate into contact with the vacuum between the various workstations. For prepared substrates, such as die cut materials, alignment apertures and corresponding alignment pins may be provided as necessary to insure proper alignment of the substrate with respect to the belt. A supply roll could-be provided at the upstream end replacing the card stock supply, and a take-up roll could be provided at the opposite end of the machine to replace the card stacking device.

The present invention provides a screen printing apparatus for transferring an image onto a substrate including feed means for moving the substrate along a fixed linear path, vacuum means for holding a substrate in at least one position along the fixed path, printing means for transferring the image onto the substrate while being held in a first position by the vacuum means and curing means for curing the image transferred to the substrate while being held in a second position by the vacuum means. It is desirable in the present invention to support and hold the substrate with respect to the feed means along a substantial portion of the fixed linear path. It is desirable to support and hold the substrate with respect to the feed means while moving between the various positions along the fixed linear path. Holding the substrate with respect to the feed means with vacuum while moving along the fixed linear path eliminates the problems and difficulties associated with the previously known carousel screen printing machines.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
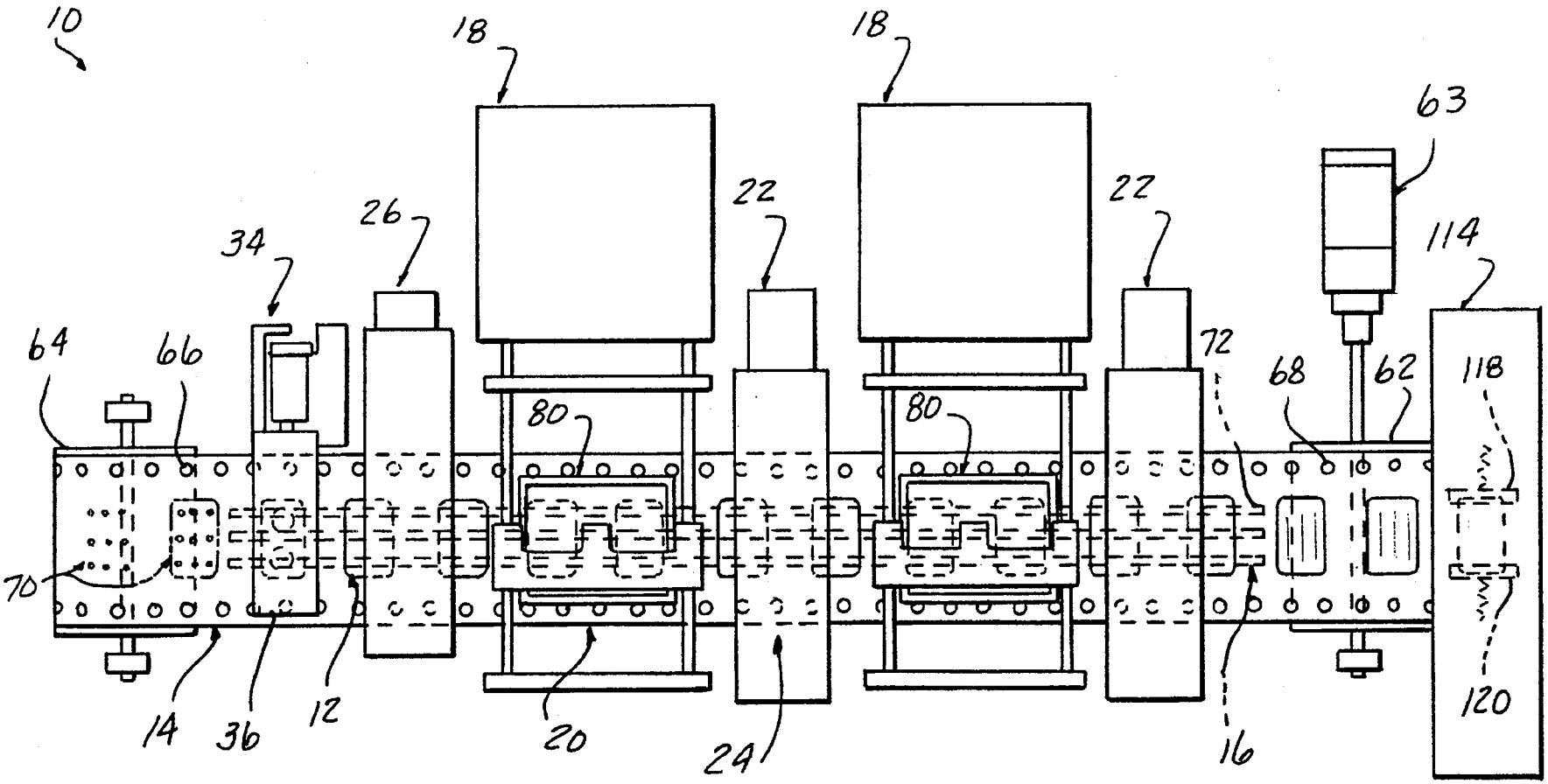
FIG. 1 is a plan view of a screen printing apparatus according to the present invention.
Figure 2:
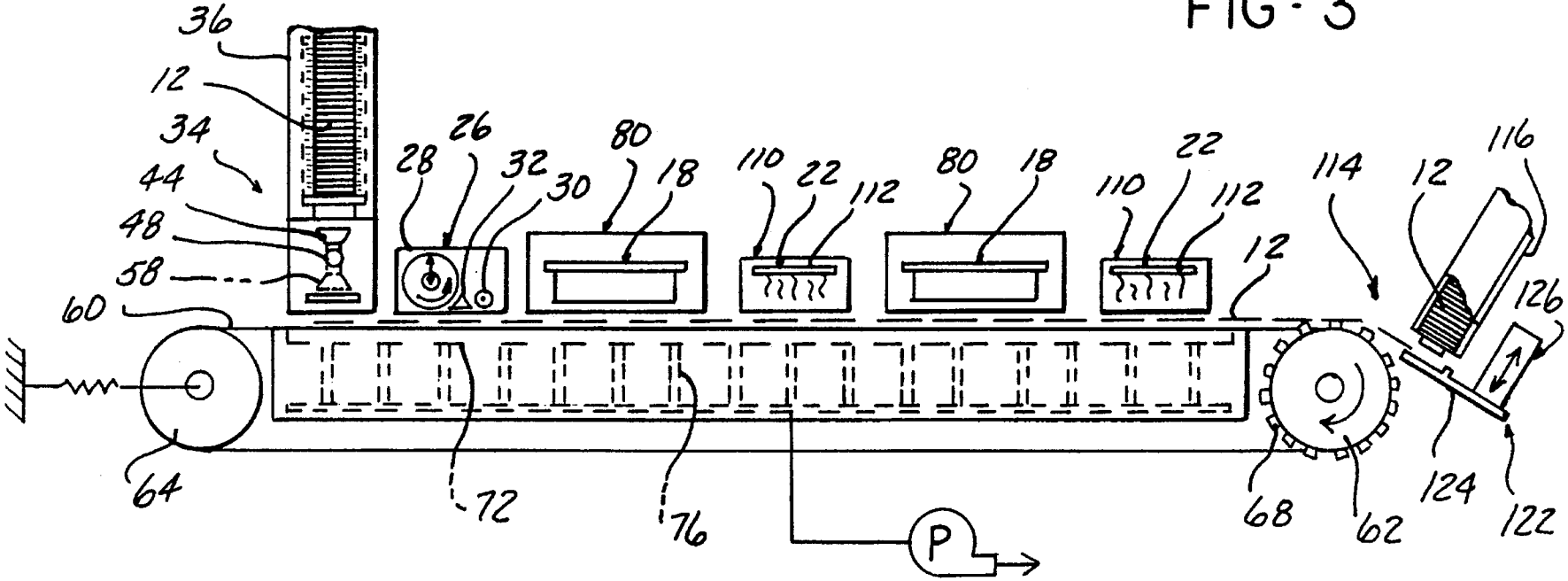
FIG. 2 is a schematic side view of the screen printing apparatus according to FIG. 1.

A screen printing apparatus 10 according to the present invention is illustrated in FIGS. 1 and 2. The screen printing apparatus 10 transfers an image onto a substrate 12. Feed means 14 moves the substrate 12 along a fixed linear path. Vacuum means 16 holds the substrate 12 in at least one position along the fixed linear path. Printing means 18 transfers the image onto the substrate 12 while being held in a first position 20 by the vacuum means 16. Curing means 22 cures the image transferred to the substrate 12 while held in a second position 24 by the vacuum means 16. In a multi-color screen printing apparatus 10 as illustrated in FIGS. 1 and 2, a plurality of printing stations and curing stations are disposed along the fixed linear path of the feed means 14.

Figure 4:
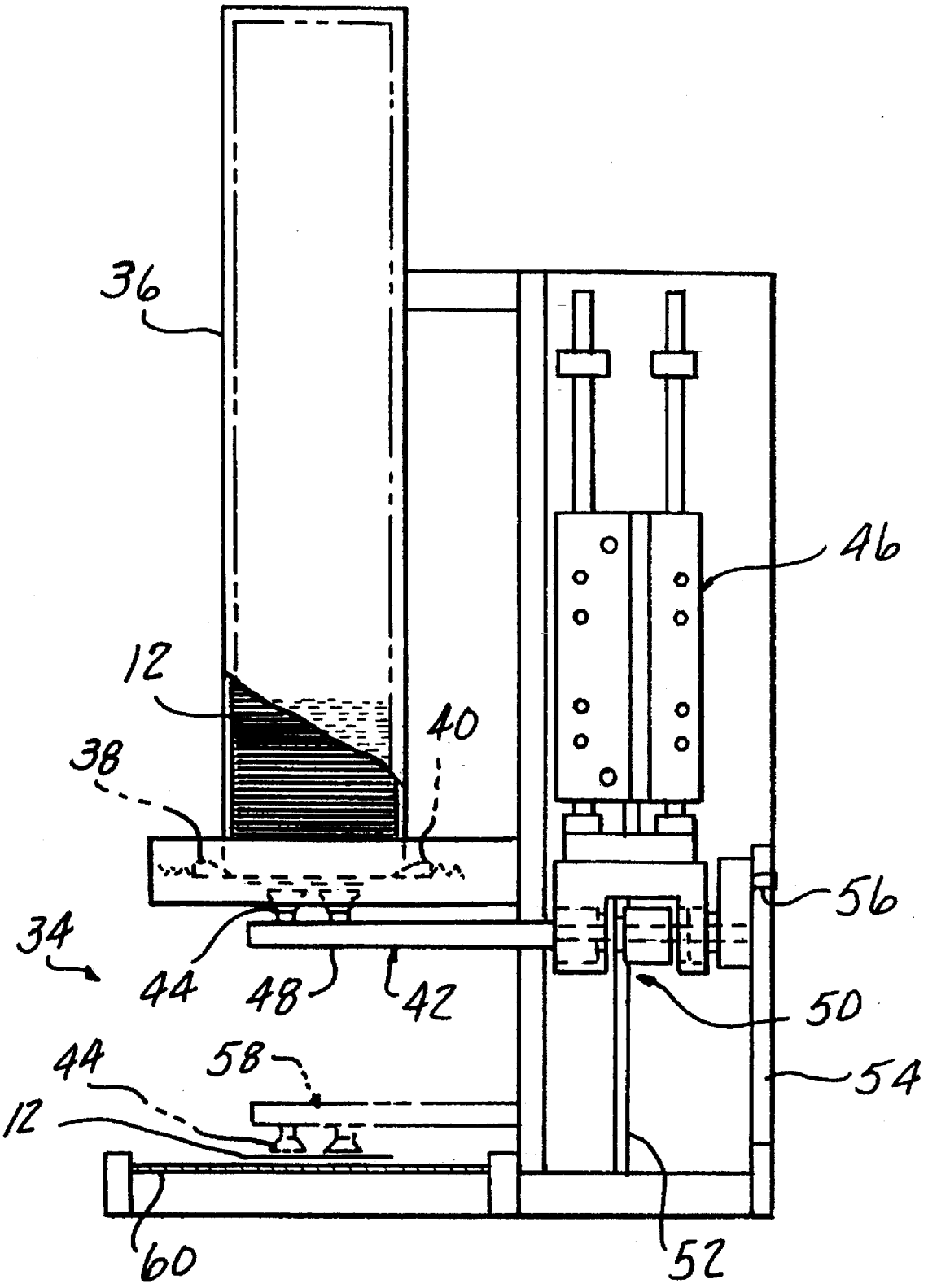
FIG. 4 is a side elevational view of a loading means for transferring a substrate to a feed means according to the present invention.

If desired, substrate cleaning means 26 may be provided to remove debris, dust or other undesirable material from the substrate 12 prior to receiving the image from the printing means 18 at the first position 20. In its preferred form, the substrate cleaning means 26 may include a tacky supply roll 28, a wedge or separator 32 to prevent the substrate 12 from being stuck to the roll 28 after contact and a substrate return roller 30 for urging the substrate back into contact with the feed means 14, if necessary. When the tacky supply roll 28 is sufficiently used, it can be regenerated by removing an appropriate section of tape from the roll 28 to expose a new clean surface portion. When the tacky supply roll 28 is completely used, the used tacky tape is removed and thrown away. A new supply roll 28 is then put in position. The tacky supply roll 28 is appropriately biased toward the feed means 14 to contact the substrate 12 and is moveable toward and away from the feed means 14 to facilitate rejuvenation and refill of the supply roll 28. The supply roll 28 also is rotatable in the direction of substrate travel as the substrate 12 passes in contact with the tacky tape. Substrate loading means 34 loads and positions the substrate 12 in a predetermined position with respect to the feed means 14. In its preferred form, the substrate loading means 34 is adapted to supply credit card size plastic sheets of substrate 12 from a supply stack held within supply housing 36, as best seen in the elevational view of FIG. 4. At the bottom of supply housing 36, inwardly extending mechanical fingers 38 and 40 are disposed in opposite sidewalls to support the stack of substrate 12 positioned extending above the mechanical fingers 38 and 40 in the supply housing 36. The substrate loading means 34 also includes a reciprocal and rotatable substrate manipulator means 42 for removing a substrate 12 from the bottom of the supply housing 36 past the mechanical fingers 38 and 40 by flexing the substrate 12 with respect to the fingers. After removing the substrate 12 from the supply housing 36, the manipulator means 42 travels a sufficient distance from the supply housing 36 to allow rotation of the manipulator means 42 and carried substrate 12 to position the substrate 12 between the manipulator means 42 and the feed means 14. The manipulator means 42 then continues toward the feed means 14 and positions the substrate 12 with respect to the feed means 14 in a predetermined position, and releases the substrate 12 onto the feed means 14.

In its preferred form, the manipulator means 42 includes a plurality of vacuum cups 44 for engaging the substrate 12. The manipulator means 42 also includes drive means 46 for moving an elongated support member 48 carrying the vacuum cups 44 reciprocally along a fixed path. The support member 48 for the plurality of vacuum cups 44 preferably includes a clutch and gear combination 50 engageable with a rack 52 as the support member 48 reciprocates along the fixed path. A cam surface 54 is formed in a fixed position with respect to the supply housing 36. A cam follower 56 is connected through the clutch and gear combination 50 to the support member 48, such that the plurality of vacuum cups 44 are held in a first upwardly extending position to engage the substrate 12 in the bottom of the supply housing 36 when adjacent a first end of the fixed reciprocal path of the drive means 46. After moving a predefined distance from the first end along the fixed path, the cam follower 56 is released from the confines of the cam surface 54 allowing rotational movement of the gear and clutch combination 50 with respect to the rack 52 to drive the elongated support member 48 rotationally about the longitudinal axis through an arc of 180° to dispose the vacuum cups in a generally downwardly extending second position as illustrated in phantom at 58 in FIG. 4. This position 58 is maintained through the remainder of the stroke toward the second end of the fixed path of the drive means 46 where the substrate 12 is released onto the feed means 14 in a predetermined position with respect thereto.

On the return stroke, the cam follower 56 is held by the cam surface 54 for a predetermined distance from the second end of the fixed path of the drive means 46 until it is released therefrom allowing the cam follower 56 to rotate in the opposite direction as driven by the gear and clutch combination 50 through contact with the rack 52 during its travel back toward the first end of the fixed path of the drive means 46. This again drives the vacuum cups 44 through 180° of rotational movement about the longitudinal axis to position the vacuum cups 44 in the first position generally extending upwardly to engage with the lowermost substrate 12 held within the supply housing 36. To engage the substrate 12, subatmospheric pressure is applied to the vacuum cups to engage with the substrate 12 held in the lowermost position of the supply housing 36. When the substrate 12 is accurately positioned with respect to the feed means 14, a short burst of above atmospheric pressure air is applied to the vacuum cups 44 to positively release the substrate 12 from the vacuum cups 44.

Figure 3:
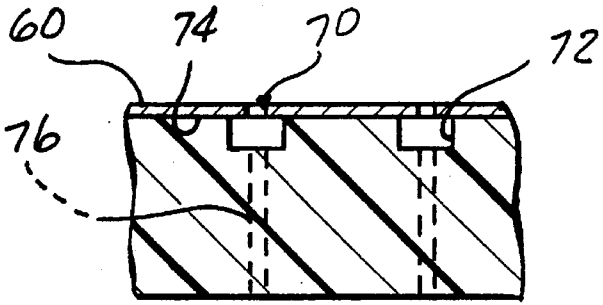
FIG. 3 is a detailed cross-sectional view of a vacuum conveyor belt means according to the present invention.

As best seen in FIGS. 1–3, the feed means 14 in its preferred form includes an endless conveyor belt 60 looped around a drive roller 62 and a spring biased idler roller 64. Preferably, the conveyor belt 60 is formed of a relatively non-stretchable material, such as stainless steel. Pin feed apertures 66 are formed along the outer peripheral edge of the conveyor belt 60 for engagement with pins 68 disposed on the drive roller 62. A pattern of individual vacuum apertures 70 are formed through the conveyor belt 60 in a pattern configuration complimentary to the shape of the substrate 12 to be moved along the fixed linear path by the feed means 14. The vacuum apertures 70 overlie and are in communication with vacuum grooves 72 formed extending longitudinally with respect to the fixed linear path in a belt support surface 74. Preferably, the belt support surface 74 is flat or planar along the fixed linear path and preferably is formed of a lubricous material, such that the material effectively acts as a lubricant or slippery surface with respect to the conveyor belt 60. Preferably, the vacuum apertures 70 stay in direct communication with the vacuum grooves 72 along substantially the entire longitudinal length of the fixed linear path, such that the substrate 12 is held in a fixed position with respect to the conveyor belt 60 once positioned over the vacuum apertures 70 and is held in the fixed position relative to the conveyor belt 60 until the substrate 12 has passed through the last curing means 22. The vacuum grooves 72 formed in the belt support surface 74 are in communication through passages 76 with a vacuum pump P.

Figure 5:
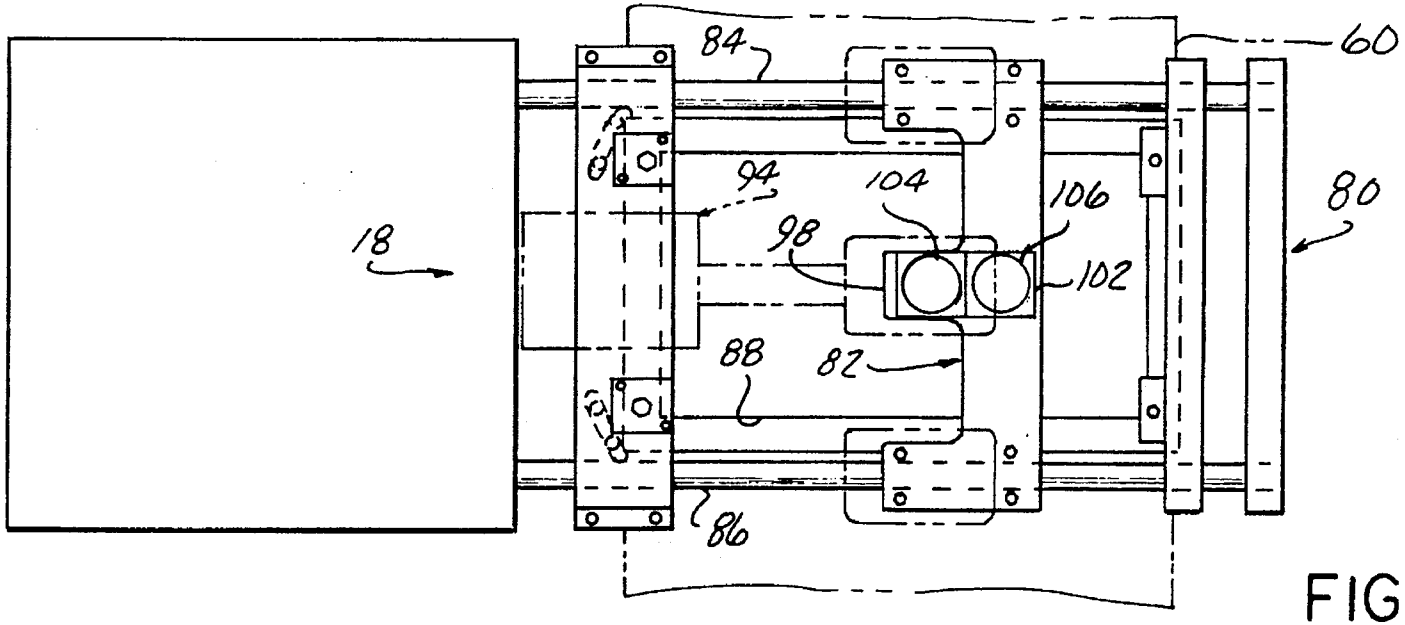
FIG. 5 is a plan view of a printing means according to the present invention.
Figure 6:
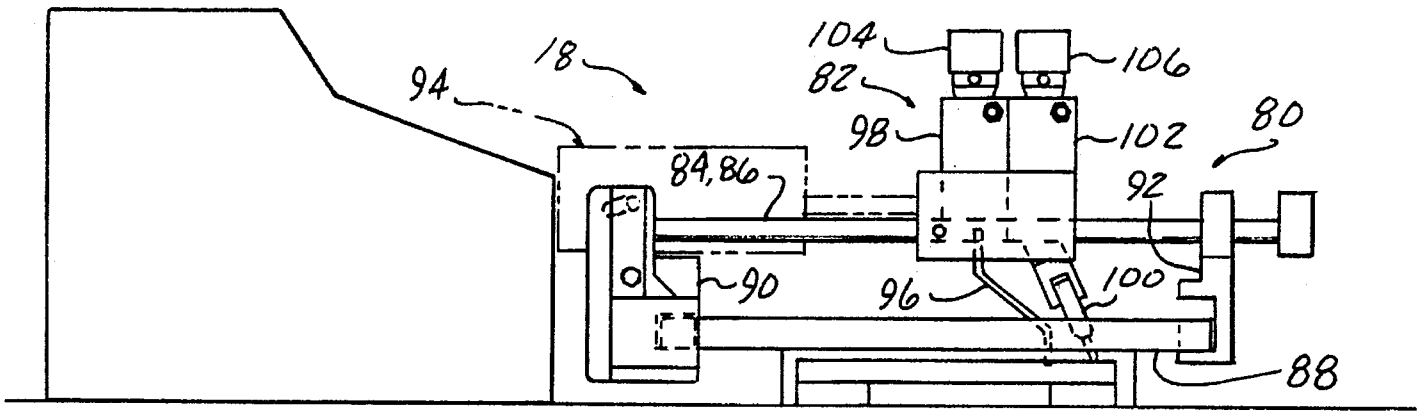
FIG. 6 is a side elevational view of the printing means illustrated in FIG. 5.

The printing means 18 is disposed at one or more discrete printing stations 80 along the fixed linear path of the feed means 14. As best seen in FIGS. 5 and 6, each printing means 18 located at each printing station 80 preferably includes a print head 82 reciprocable along a path generally transverse to the fixed linear path of the feed means 14. The print head 82 is supported for reciprocating transverse motion on longitudinally spaced apart rails 84 and 86 extending transversely across and above the conveyor belt 60. A silk screen 88 is supported from the rails 84 and 86 by opposed clamp members 90 and 92. Clamp members 90 and 92 are transversely spaced and extend longitudinally between the longitudinally spaced transverse rails 84 and 86. Clamp members 90 and 92 are adjustable in the transverse direction along the rails 84 and 86 to releasably engage the silk screen 88. The transverse adjustability of the clamp members 90 and 92 also allows for accurate positioning of the silk screen 88 with respect to the substrate 12 to be imprinted.

Reciprocating means 94 is connected to the print head 82 for reciprocally moving the print head 82 along the transversely extending rails 84 and 86. The print head 82 includes a vertically movable flood bar 96 and adjustable actuator means 98 for moving the flood bar 96 between a lowered position for spreading ink evenly over the surface of the silk screen 88. The print head 82 also includes a squeegee 100 vertically movable between a raised position and a lowered position, and an adjustable actuator means 102 for moving the squeegee 100 between the raised position and the lowered position. When in the lowered position, the squeegee 100 acts across the surface of the silk screen 88 to apply the ink or other image creating material onto the substrate 12. Adjusting knobs 104 and 106 on the adjustable actuator means 98 and 102 respectively, provide for accurate adjustment of the lower vertical position of the flood bar 96 and squeegee 100 respectively.

In operation, with the print head 82 initially located to the left as illustrated in FIGS. 5 and 6, away from the operator, printing media, such as ink, is applied to the surface of the silk screen 88 and with the flood bar 96 in the lowered position and the squeegee 100 in the raised position, the reciprocating means 94 drives the print head 82 to the right as illustrated in FIGS. 5 and 6 to spread the printing media evenly across the silk screen 88 with the flood bar 96. After reaching the rightmost end of travel as illustrated in FIGS. 5 and 6, the flood bar 96 is moved to the raised position by actuator means 98 and squeegee 100 is lowered to the lower position by actuator means 102, while a substrate 12 is positioned accurately beneath the silk screen 88 by movement of the endless conveyor belt 60. After positioning the substrate 12 with respect to the silk screen 88, the reciprocating means 94 moves the print head 82 from the rightmost position toward the left as illustrated in FIGS. 5 and 6. During this motion, the squeegee 100 applies the print media through the silk screen 88 onto the substrate 12. Upon reaching the leftmost end of travel as illustrated in FIGS. 5 and 6, the squeegee 100 is moved by actuator means 102 to the raised position, and flood bar 96 is moved by actuator means 98 from the raised position to the lowered position. The cycle then repeats after additional print media has been applied to the silk screen 88 for spreading by the flood bar 96 as previously described.

The vacuum belt conveyor 60 locates the substrate 12 with respect to each printing station 80 as it moves sequentially along the fixed linear path. The vacuum conveyor belt 60 is controlled by drive roller 62 which can be driven by a servo motor 63 for accurate electronic control or by a mechanical indexer. The servo motor preferably is capable of linear movement up to 300 feet per minute, with an average movement of substrate along the fixed linear path of 60 feet per minute. The relative belt location with respect to each printing station 80 determines the rough adjustment or placement of the respective colors being applied to the substrate 12 at the individual printing stations 80. Microadjustment or fine tuning of the overlying colors, or with the colors with respect to one another can be controlled by mechanical or electronic settings, such as stepper motors (not shown) connected to the individual print heads 82 or silk screens 88 at each printing station 80 allowing relative movement longitudinally or transversely of the print heads 82 or silk screens 88 with respect to one another.

Preferably, a curing station 110 is located downstream of each printing station 80. Each curing station 110 includes curing means 22 for fixing the print media with respect to the substrate 12. The curing means 22 can include any appropriate curing mechanism for the particular type of print media being used. By way of example, when using colored or transparent ink, ultraviolet lights 112 may be provided for drying the ink on the substrate 12. The curing means 22 can cure or fix the print media to the substrate 12 while the conveyor belt 60 is in a stationary position, which typically occurs for approximately 1 second while the printing stations 80 are applying print media to subsequent substrates 12. In addition, at other curing stations 110, or in the alternative, the curing means 22 may cure or fix the print media to the substrate 12 while the substrate 12 is being transported by the conveyor belt 60 through the curing station 110. Typically, the transport speed by the conveyor belt 60 through such a curing station in accordance with the present invention would be anticipated to be approximately 100 ft/min, while the maximum possible conveyor belt speed of approximately 300 ft/min.

Unloading means 114 is provided for removing substrate 12 from the feed means 14. As best seen in FIG. 2, the unloading means 114 can include a storage housing 116 for accumulating a vertically extending stack of substrate 12. In its preferred form, the substrate unloading means 114 is adapted to store credit card size plastic sheets of substrate 12 in a vertically extending stack held within the storage housing 116. At the bottom of the storage housing 116, inwardly biased mechanical fingers 118 and 120 (FIG. 1) extend toward one another from opposite sidewalls to support the stack of substrate 12 positioned above the mechanical fingers 118 and 120 in the storage housing 116. Substrate transfer means 122 is provided to receive the substrate 12 from the feed means 14. In the preferred embodiment, the substrate transfer means 122 includes a reciprocable substrate-receiving plate or platform 124. When in the lower or first position, platform 124 receives the substrate 12 as it passes over drive roller 62. The substrate 12 is urged to slide completely onto the platform 124 due to its inclination with respect to horizontal. Once the substrate 12 is received on the platform 124, the platform 124 is reciprocated upwardly by actuator 126 into a second position driving the substrate 12 against the inwardly biased, mechanical fingers 118 and 120 until the mechanical fingers 118 and 120 retract toward the storage housing 116 allowing the substrate 12 to pass above the mechanical fingers 118 and 120. The platform 124 can then be reciprocated to the first position to receive another substrate 12 from the endless conveyor belt 60. The substrate 12 is held in position within the storage housing 116 by the mechanical fingers 118 and 120 again being inwardly biased to contact a lower surface of the substrate 12 adjacent opposite edges. Storage housing 116 is of sufficient size to accumulate a stack of completed substrates 12 having the desired image imprinted thereon.

Various modifications are considered to be within the scope of the present invention. For example, if the substrate 12 to be imprinted is in continuous form, the loading means 34 may take the form of a supply roll of substrate 12 with appropriate idle rollers to bring the substrate into contact with the endless vacuum conveyor belt 60 for transport along the fixed linear path for printing and curing as previously described. In this configuration, the unloading means 114 can take the form of a take-up roll for the substrate 12. If required, the substrate 12 could include alignment apertures 66 extending along the outer edges for engagement with corresponding alignment pins 68 disposed in respect to the vacuum belt for positioning the substrate with respect to the belt.

Figure 7:
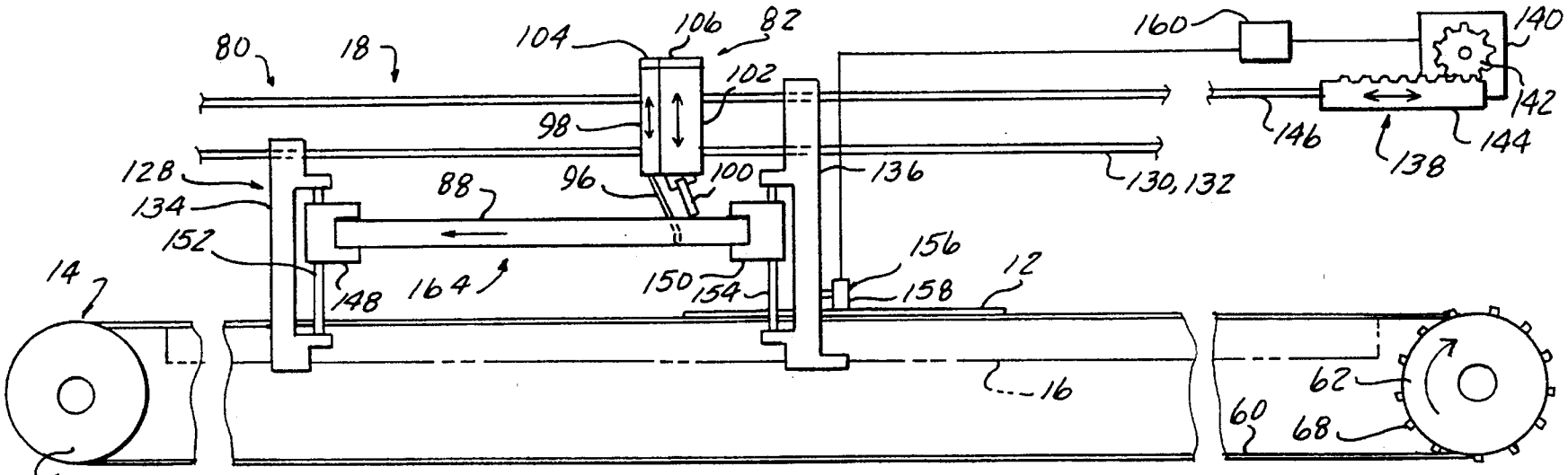
FIG. 7 is a schematic side view of an alternative embodiment of a screen printing apparatus according to the present invention with continuous substrate movement and synchronized movable printing means.
Figure 8:
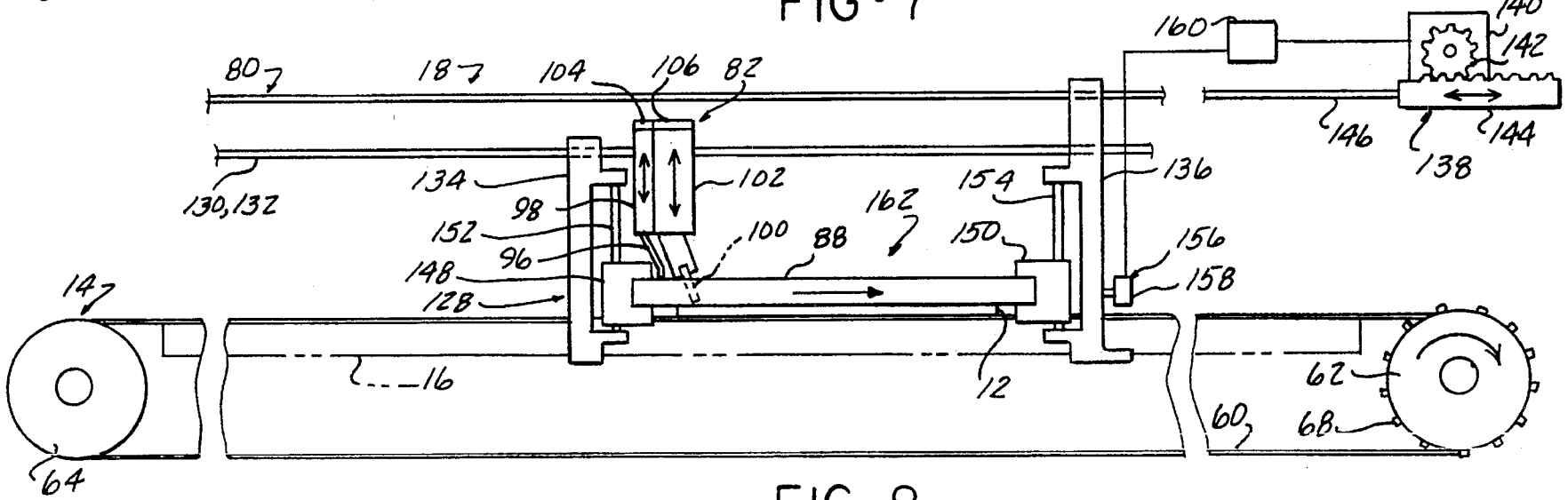
FIG. 8 is a schematic side view of the alternative embodiment of a screen printing apparatus in a second lowered downstream position.

FIGS. 7 and 8 illustrate a modified or alternative embodiment of the present invention. In this configuration, it is desirable to maintain a generally steady rate of travel for the feed means 14 carrying the substrate 12 along the fixed linear path. As previously described, the feed means 14 may include a conveyor belt 60 formed of a relatively non-stretchable material, such as stainless steel. Feed apertures 66 (FIG. 1) are formed along the outer peripheral edges of the conveyor belt 60 for engagement with pins 68 disposed in a drive roller 62. A pattern of individual vacuum apertures 70 (FIG. 3) are formed through the conveyor belt 60 in a pattern configuration complimentary to the shape of the substrate 12 to be moved along the fixed linear path by the feed means 14. Since a substantially constant transport speed is desirable in this configuration, the drive roller 62 can be driven by a DC motor or the like. The individual vacuum apertures 70 formed in the conveyor belt 60 overlie and are in communication with vacuum grooves 72 formed extending longitudinally with respect to the fixed linear path in a belt support surface as shown in FIG. 3 and previously described.

In this embodiment, each of the previously described stations can be the same, except for the printing means 18. The printing means 18 can be disposed at one or more discrete printing stations 80 along the fixed linear path of the feed means 14. However, each printing means 18 located at each printing station 80 preferably, as illustrated in FIGS. 7 and 8, includes a stationary print head 82 with a vertically movable flood bar 96 adjustable between a lowered position for spreading ink evenly over the surface of a silk screen 88 and a raised position spaced from the surface of the silk screen 88. Each print head 82 also includes a squeegee 100 vertically movable between a raised position spaced from the surface of the silk screen 88 while the flood bar 96 is in the lowered position, and a lowered position to apply the ink or other image creating material onto the substrate 12 while the flood bar 96 is in the raised position.

In this embodiment, rather than having the print head 82 reciprocal along a path generally transverse to the fixed linear path of the feed means 14, the print head 82 is stationary while a screen supporting carriage 128 is reciprocal longitudinally along the fixed linear path of the feed means 14. The screen supporting carriage 128 is supported for reciprocating longitudinal motion on longitudinally spaced apart rails, 130 and 132 respectively, extending longitudinally along opposite sides and above the conveyor belt 60. In this embodiment, clamp members 134 and 136 are longitudinally spaced and extend transversely between the longitudinally spaced longitudinally extending rails 130 and 132. Clamp members 134 and 136 are adjustable in the transverse direction along the rails 130 and 132 to releasably engage the screen 88. The transverse adjustability of the clamp members 134 and 136 also allows for accurate positioning of the silk screen 88 with respect to the substrate 12 to be imprinted.

Reciprocating means 138 is connected to the screen 88 through clamp members 134 and 136 for reciprocally moving the screen 88 along the longitudinally extending rails 130 and 132. In this embodiment, reciprocating means 138 may include a servo motor 140 for rotatably driving a gear 142. The gear 142 meshingly engages with a rack 144 connected to a drive shaft 146 for reciprocation along the longitudinal axis of the drive shaft 146. The drive shaft 146 is supported for reciprocation extending parallel to the linear fixed path of the feed means 14. At least one of the clamp members 134 and 136 is connected to the drive shaft 146 for transferring the reciprocating motion of the drive shaft 146 to the screen 88. The screen 88 is supported by the clamp members 134 and 136 through vertically extending slide members 148 and 150 engaging vertical shafts 152 and 154 allowing the screen 88 to be moved vertically by actuators (not shown) with respect to the feed means 14 carrying the substrate 12. Sensor means 156 is provided for synchronizing the motion of the screen carriage assembly 128 with the rate of travel of the feed means 12 during the printing operation and to assure proper registration of the screen 88 with respect to the substrate 12 carried by the conveyor belt 60. The sensor means 156 may include a sensor 158 mounted to the screen carriage 128 assembly for sensing passage of the drive apertures 66 disposed in the conveyor belt 60 along opposite edges of the conveyor belt 60. The sensor signal is fed through appropriate control means 160 to monitor and control the operation of the servo motor 140.

In operation, this embodiment of the present invention would begin an operation cycle with the screen 88 having just been quickly returned from a downstream position 162 to an upstream position 164 with respect to the linear fixed path of travel for the substrate 12 carried by the conveyor belt 60. After the screen carriage 128 has stopped at the upstream location 164, the servo motor 140 is controlled to begin driving the rack 144 and connected drive shaft 146 in the same direction as the belt 60, only slightly faster than the belt speed. As the screen support carriage 128 catches up with the speed of the belt 60, and eventually may begin moving faster than the speed of the belt 60, the sensor 158 eventually aligns with an aperture 66 in the belt 60 at which time the servo motor 140 is controlled to maintain the sensor 158 in alignment with the aperture 66 in the conveyor belt 60. The screen 88 is lowered into contact with the substrate 12 carried on the belt 60 while the belt 60 remains in motion, and the squeegee 100 is lowered into contact with the screen 88, so that as the screen 88 moves in synchronized motion with the conveyor belt 60, the squeegee 100 applies the print media to the substrate 12 due to the relative motion of the screen 88 with respect to the squeegee 100. When the screen 88 has passed beneath the stationary print head and associated squeegee 100 so that the entire image has been transferred to the substrate 12, the squeegee 100 is raised vertically by the print head 82 and the screen 88 is raised vertically out of contact with the substrate 12. The servo motor 140 is then controlled to rapidly reverse direction to return the screen carriage assembly 128 from the downstream location 162 to the upstream location 164. During transport from the downstream location 162 to the upstream location 164, the flood bar 96 is lowered into contact with the screen 88 and additional print media is applied to the screen 88 and spread evenly by the spread bar 96 as the screen 88 moves in the opposite direction with respect to the belt 60 and moves relative to the stationary print head 82 and associated flood bar 96. After reaching the upstream location 164, the cycle is repeated for the next substrate 12 in the same manner as previously described.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A screen printing apparatus for transferring an image onto a substrate comprising:

feed means for simultaneously moving a plurality of discrete, individual substrates along a fixed linear path spaced longitudinally from one another;

vacuum means for continuously holding each discrete, individual substrate in position with respect to said feed means as each substrate travels along the fixed path, said vacuum means including a longitudinally extending groove extending substantially along an entire longitudinal length of said fixed path for maintaining continuous vacuum pressure with respect to each of said discrete, individual substrates through said feed means as each substrate travels along said fixed path;

printing means for transferring the image onto each substrate, the printing means including a printing station for each color to be applied disposed spaced longitudinally from one another along the fixed path;

curing means for curing the image transferred to each substrate, the curing means disposed spaced longitudinally along the fixed path at locations downstream from each of the printing stations of the printing means;

loading means for transferring a substrate to the feed means in a predetermined position, wherein the loading means further includes a storage housing for receiving a plurality of stacked, individual, planar substrates, support means for releasably retaining a lowermost substrate in the stack of substrates within the housing, and substrate manipulator means for engaging the lowermost substrate in the stack of substrates and for removing the engaged substrate from the housing such that the support means engages a substrate previously disposed immediately above the engaged substrate to be removed; and means for reciprocating the manipulator means along a linear path between first and second end limits of movement and for rotating the manipulator means about an axis generally perpendicular to the linear path for positioning the substrate between the manipulator means and the feed means while placing the substrate on the feed means in a predefined position.

2. The screen printing apparatus of claim 1 wherein the feed means further comprises:

a substantially non-stretchable, stainless steel vacuum conveyor belt having a plurality of longitudinally spaced apertures formed therein for engaging and for transporting the substrate along the fixed path, the vacuum means engaging the substrate through the conveyor belt during transport along the fixed path.

3. The screen printing apparatus of claim 1 further comprising:

the substrate manipulator means including at least one vacuum cup for engaging the substrate.

4. The screen printing apparatus of claim 1 further comprising:

substrate unloading means for removing the substrate from the feed means after printing and curing have been completed.

5. The screen printing apparatus of claim 4 wherein the substrate unloading means further comprises:

a storage housing for receiving and stacking a plurality of individual, planar substrates after printing and curing;

retention means for releasably retaining a lowermost substrate in the stack of substrates within the storage housing; and substrate transfer means for engaging the substrate and for moving the substrate from the feed means into the storage housing such that the substrate is positioned above the retention means and the previously lowermost substrate is moved vertically upward and supported on top of the substrate being moved from the feed means by the transfer means.

6. The screen printing apparatus of claim 5 wherein the substrate transfer means further comprises:

a platform inclined from horizontal for receiving a substrate from the feed means; and reciprocating means for lifting the platform in a vertical direction until the substrate is engaged above the retention means.

7. The screen printing apparatus of claim 1 wherein the printing means further comprises:

at least one elongated rail disposed above the feed means;

a print head reciprocally supported from the rail for movement with respect to the feed means between first and second end limits of movement; and a print screen disposed between the print head and the substrate for applying a desired image to the substrate.

8. The screen printing apparatus of claim 7 wherein the print head further comprises:

a flood bar for spreading print media evenly over the print screen;

flood bar actuator means for raising and lowering the flood bar with respect to the print screen between a raised position and a lowered position;

a squeegee for applying the print media to the substrate through the print screen; and squeegee actuator means for raising and lowering the squeegee with respect to the print screen between a raised position and a lowered position, such that the squeegee is in the raised position and the flood bar is in the lowered position while the print media is applied to the print screen, and that the squeegee is in the lowered position and the flood bar is in the raised position when the print media is applied to the substrate.

9. A screen printing apparatus for transferring an image onto a substrate comprising:

feed means for simultaneously moving a plurality of discrete, individual substrates along a fixed linear path spaced longitudinally from one another;

vacuum means for continuously holding each discrete, individual substrate in position with respect to said feed means as each substrate travels along the fixed path, said vacuum means including a longitudinally extending groove extending substantially along an entire longitudinal length of said fixed path for maintaining continuous vacuum pressure with respect to each of said discrete, individual substrates through said feed means as each substrate travels along said fixed path;

printing means for transferring the image onto each substrate, the printing means including a printing station for each color to be applied disposed spaced longitudinally from one another along the fixed path;

curing means for curing the image transferred to each substrate, the curing means disposed spaced longitudinally along the fixed path at locations downstream from each of the printing stations of the printing means;

loading means for transferring a substrate to the feed means in a predetermined position, wherein the loading means further includes a storage housing for receiving a plurality of stacked, individual, planar substrates, support means for releasably retaining a lowermost substrate in the stack of substrates within the housing, and substrate manipulator means for engaging the lowermost substrate in the stack of substrates and for removing the engaged substrate from the housing such that the support means engages a substrate previously disposed immediately above the engaged substrate to be removed, an elongated support member having a longitudinal axis and moveable in a plane generally parallel to the longitudinal axis along a fixed path between first and second positions, a plurality of vacuum cups supported adjacent one end of the support member for releasably engaging the substrate, a rack supported in fixed position relative to the storage housing, a gear and clutch combination connected to the support member such that the gear engages the rack, a cam surface formed in a fixed position relative to the housing, and a cam follower connected to the support member and engageable with the cam surface such that the clutch prevents rotation of the support member when the cam follower is restrained from rotation by the cam surface and the clutch allows rotation of the support member when the cam follower rotates about the longitudinal axis, the cam follower and support member driven in rotation by engagement between the gear and rack as the support member is moved between the first and second positions.

10. A screen printing apparatus for transferring an image onto a substrate comprising:

feed means for moving the substrate along a fixed linear path;

vacuum means for holding the substrate in at least one position along the fixed path;

printing means for transferring the image onto the substrate, the printing means disposed along the fixed path;

curing means for curing the image transferred to the substrate, the curing means disposed along the fixed path at a location downstream from the printing means; and cleaning means for removing debris from a surface of the substrate to be imprinted, wherein the cleaning means further includes a first roll having an elongated strip of material with a surface having an adhesive substance for engagement against the substrate, a wedge for urging the substrate away from the strip after contact, and a roller for urging the substrate back into contact with the feed means.

11. A screen printing apparatus for transferring an image onto a substrate comprising:

feed means for moving the substrate along a fixed linear path, the feed means including a stretch resistant, endless conveyor belt having a plurality of apertures formed therein;

vacuum means continuously engageable through the apertures formed in the conveyor belt along substantially an entire longitudinal length of the fixed linear path for holding the substrate in a fixed position with respect to the conveyor belt as the substrate is carried along the fixed linear path;

loading means for transferring a substrate to the feed means in a predetermined position, the loading means including a storage housing for receiving a plurality of stacked, individual, planar substrates, support means for releasably retaining a lowermost substrate in the stack of substrates within the housing, reciprocable substrate manipulator means for engaging the lowermost substrate in the stack of substrates and for removing the engaged substrate from the housing such that the support means engages a substrate previously disposed immediately above the engaged substrate to be removed, the reciprocable substrate manipulator means including an elongated support member having a longitudinal axis and moveable in a direction generally coplanar to the longitudinal axis along a fixed path between first and second positions, a plurality of vacuum cups supported adjacent one end of the support member for releasably engaging the substrate, a rack supported in fixed position relative to the storage housing, a gear and clutch combination connected to the support member such that the gear engages the rack, a cam surface formed in a fixed position relative to the housing, a cam follower connected to the support member and engageable with the cam surface such that the clutch prevents rotation of the support member when the cam follower is restrained from rotation by the cam surface and the clutch allows rotation of the support member when the cam follower rotates about the longitudinal axis, the cam follower and support member driven in rotation by engagement between the gear and rack as the support member is moved between the first and second positions;

printing means for transferring the image onto the substrate;

curing means for curing the image transferred to the substrate; and substrate unloading means for removing substrate from the feed means after printing and curing have been completed, the unloading means including a storage housing for receiving and stacking the plurality of individual, planar substrates after printing and curing, retention means for releasably retaining a lowermost substrate in the stack of substrates within the storage housing, substrate transfer means for engaging the substrate and for moving the substrate from the feed means into the storage housing such that the substrate is positioned above the retention means and the previously lowermost substrate is moved vertically upward and supported on top of the substrate being moved from the feed means by the transfer means, the transfer means including a platform inclined from horizontal for receiving a substrate from the feed means, and reciprocating means for lifting the platform in a vertical direction until the substrate is engaged above the retention means.

* * * * *